US005212842A

United States Patent [19]

Glydon

[11] Patent Number: 5,212,842

[45] Date of Patent: May 25, 1993

[54] CHILD'S INTERLOCKABLE FOAM PAD, FOAM PAD STRUCTURE AND METHOD

[75] Inventor: Jon A. Glydon, West Barnstable, Mass.

[73] Assignee: PI Consumer Products Corporation, Hyannis, Mass.

[21] Appl. No.: 946,966

[22] Filed: Sep. 17, 1992

[51] Int. Cl.[5] ..... A63H 33/08; A47G 9/06

[52] U.S. Cl. ..... 5/420; 5/465; 5/481; 482/23; 446/85; 446/116; 446/127

[58] Field of Search ..... 5/417–420, 5/465, 481; 52/DIG. 10, 594; 482/23; 446/85, 108, 114, 115, 116, 125, 127

[56] References Cited

U.S. PATENT DOCUMENTS

| | | | |
|---|---|---|---|
| 3,047,888 | 8/1962 | Shecter et al. | 5/481 |
| 3,118,153 | 1/1964 | Hood | 5/481 X |
| 3,701,214 | 10/1972 | Sakamoto | 446/115 |
| 4,147,828 | 4/1979 | Heckel et al. | 5/420 X |
| 4,242,767 | 1/1981 | McMullen et al. | 5/465 |
| 5,052,158 | 10/1991 | D'Luzansky | 52/594 X |

FOREIGN PATENT DOCUMENTS 2516843 10/1976 Fed. Rep. of Germany ..... 5/417

*Primary Examiner*—Michael F. Trettel

*Attorney, Agent, or Firm*—Richard P. Crowley

[57] ABSTRACT

An interlockable foam pad adapted with other interlockable foam pads to form foam pad structures, such as a three-dimensional structure or a foam pad exercise mat. The foam pad comprises a core foam layer of a polyethylene foam layer, the top and bottom foam layers having a higher density than the polyethylene foam in the core foam layer, and having a thickness considerably less than the thickness of the core foam layer. The foam pad includes at least along one side edge, and typically along a plurality of side edges, a plurality of alternatingly spaced apart uniform male and female sections, and which sections are adapted to interlock together with slight hand pressure with the male and female sections of an adjacent foam pad. The interlockable foam pad, which is a very low density of the core foam layer, and the higher density of the top and bottom of the foam layer, permits the employment of very light pressure, such as pressure exerted by a child, to provide for the interlocking of the male and female sections to form a foam pad structure.

11 Claims, 2 Drawing Sheets

CHILD'S INTERLOCKABLE FOAM PAD, FOAM PAD STRUCTURE AND METHOD

BACKGROUND OF THE INVENTION

Foam pads composed of a flexible foam type material such as polyvinylchloride, urethane and olefinic polymers, such as polyethylene, typically having a thickness of about ½ to 1½ inches and having one or more side edges with interlockable male and female sections are well known. The foam pads are used to prepare foam type exercise pads, for example, where the foam pads have the male and female interlockable sections on two or three side edges, and are also used for children's play toys for the construction of three-dimensional interlockable foam structures, such as for example a box with diecut-out numbers or figures in the pad or house type structures. Such interlockable foam pads are composed of a single foam sheet material having a single foam density, generally of a sufficiently high density to permit the structural integrity of the three-dimensional structures to be formed by the interlocking foam pads, such as for example having a foam sheet material of 5 pcf or more and may be formed for example of cross-linked substantially closed-cell polyethylene foam material.

Interlocking of the male and female sections adjoining foam pads is accomplished by aligning of male sections over the female sections and thereafter exerting a downward force on the male sections to go into and to align in a single plane the male section with the female section to form the interlocking foam pad structure. Where such interlockable foam pad structures are employed with children, particularly young children of less than about 6 to 8 years of age, such children find increased difficulty in assembling such foam pad structures due to the amount of pressure required to form the interlocking foam pad structures.

It is desired to provide for a new and improved interlockable foam pad to form interlockable foam pad structures, particularly adapted for use by children, wherein the interlocking of the foam pads together to form the foam pad structures is easily and simply accomplished and yet which does not affect the interlocking ability of the foam pad or the structural integrity of the resulting structures.

SUMMARY OF THE INVENTION

The invention relates to an interlockable foam pad and foam pad structures formed by the interlockable foam pads and to a method of forming such structures. In particular the invention concerns interlockable foam pads and foam pad structures which may easily be used and assembled by children.

An interlockable foam pad has been found which is adaptable for use for interlocking with another foam pad, typically of the same type structure to form an interlockable structure, such as an exercise mat or more particularly a three-dimensional interlockable foam pad structure such as a child's box or playhouse or other interlockable children's structures. The foam pad apparatus of the invention comprises a core foam layer comprised of foam material having a very low foam density, for example, a polyethylene such as a cross-linked, closed-cell polyethylene foam type material wherein the density of the foam material is less than about 13 pcf and wherein the thickness of the core foam layer is substantially greater than the thickness of a top and bottom foam layer and in one embodiment may range from ¼–1½ inches. The interlockable foam pad also includes a top and bottom foam layer bonded to the core layer and typically composed but not necessarily of the same type foam material such as a polyethylene and more particularly a crosslinked polyethylene. The top and bottom foam layers have a foam density which is greater than the foam density of the core foam layer, generally having a foam density of greater than 5 pcf, for example 5 to 12 pcf and particularly having a thickness substantially less than the very lightweight core foam layer. Generally the thickness of the top and bottom foam layers are the same, and would range from about 5 to 25 percent of the thickness of the core foam layer, for example, and in one embodiment may range from about 1/16 to ¼ inches in thickness.

The foam pad also includes at least along one side edge and typically along two or three where a physical exercise mat is being formed, and more particularly along all side edges where a three-dimensional structure is to be formed, a plurality of alternating, spaced apart generally uniform male and female sections, such as a "T"-type section, which male and female sections are adapted to interlock with slight hand pressure by the user, in particular a child, with male and female side edge sections adjacent to a similar and typically the same foam pad to permit for example a child to push easily against the harder toughened top and bottom foam layers which provide structural integrity to the foam pad and to depress easily the very lightweight core foam layer in order to form a desired interlocked foam pad three-dimensional structure with low pressure.

It has been discovered that where an interlockable foam pad includes a very lightweight core foam layer together with high density structural type top and bottom layers the task of assembling an interlockable foam pad structure such as an exercise mat or a three-dimensional object is substantially easier, since the amount of pressure to interlock merely has to be exerted against the top and bottom foam layers which provide the necessary stiffness to insert them into a lightweight, yielding core foam layer, thus permitting very low hand pressure, such as the hand pressure of a child, to easily interlock the adjoining interlockable foam pads. The high density top and bottom layer provide sufficient stiffness to provide structural integrity to the interlocked structures.

The employment of a very lightweight core foam layer in employing an interlockable foam pad having a lightweight core foam layer in top and bottom foam layers of a higher density overcomes many of the difficulties associated with the employment of such structures wherein the entire structure is composed of a higher density, uniform foam type material, wherein any user must overcome a significant amount of pressure throughout the entire depth of the uniform density interlockable foam pad in order to assemble an interlockable structure. The interlockable foam pads of the invention provide for easy interlockability, and in addition does not diminish the interlockability of the resulting interlocked structure. The stiff high density top and bottom foam layers provide for a tough outer surface of the lightweight core foam layer which gives surface integrity to permit a user to push against the top and bottom layer without collapse while the very lightweight density layer of the core foam layer does not provide much resistance for the depression of the core foam layer and interlocking of the foam pad.

In addition, it has been found that the interlocked foam pads once in interlock have the same or greater locking mechanism than solid foam pads. Typically the "T"-type male and female sections employed as the interlocking means have rounded type edges and particularly along the edge of the foam pad, the side edge along the foam pad of the female section is typically 30 to 50 percent or more longer than the opening of the female section or the base of the male section along the side edges. Thus the interlockable foam pad and foam pad structures of the invention provide for a much easier assembly with the use of less pressure and also provides for the same or better locking mechanism interlockable foam pads.

The interlockable means employed within the foam pads are typically comprised of male and female members which must be pushed together to form the interlockable technique. However the nature of the male and female members may vary, but typically are "T"-shape or dovetail type members which are rounded at the edges and generally trapezoidal in nature, although other shapes of male and female interlockable sections may be used to obtain the advantages of the invention. The interlockable foam pad, which includes the higher density top and bottom foam layers, also permits the male and female "T"-type sections to use a greater side angle, which would not be possible employing an integral foam type material, since there would be less resistance to pulling apart of the interlock structures in the same plane. Thus the interlockable foam pad of the invention also provides the advantage of the greater angle of the male and female sections that may be increased over the typical angles employed in solid foam sections and obtained a higher degree of planar interlockability.

The invention will be described for purposes of illustration only in connection with certain embodiments. However, it is recognized that those persons skilled in the art may make various changes, modifications and improvements in the illustrated embodiments without departing from the spirit and scope of the invention.

DESCRIPTION OF THE EMBODIMENTS

Figure 1:
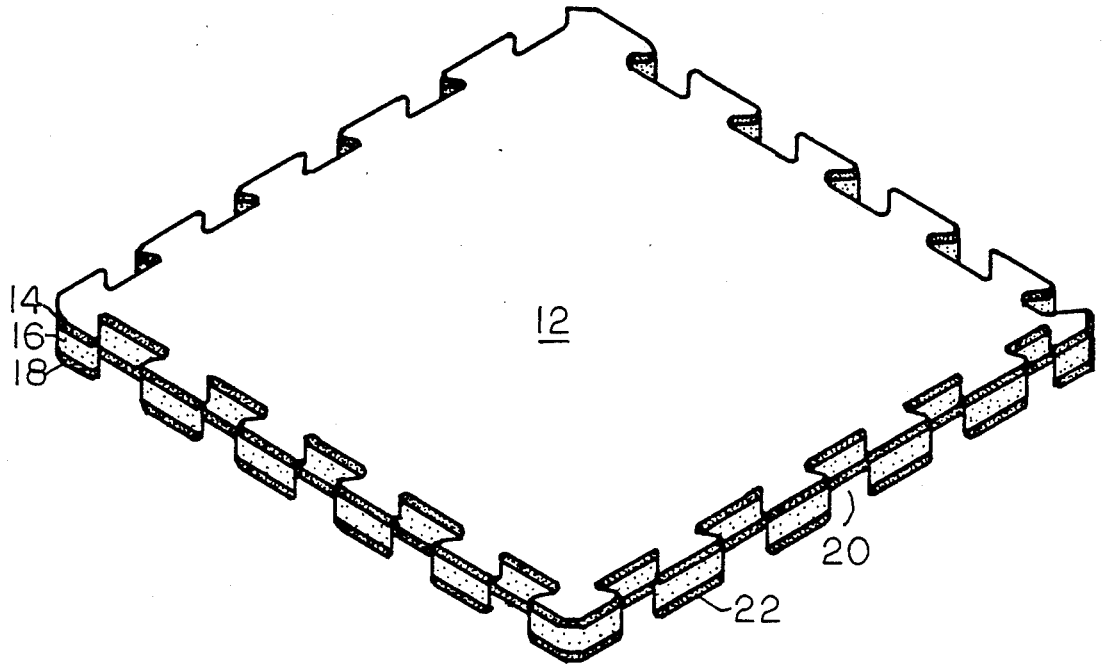
FIG. 1 is a perspective view from above of an interlockable foam pad of the invention.

FIG. 1 shows an interlockable foam pad 12 composed of a lightweight core foam layer 16 composed of a substantially closed-cell cross-linked polyethylene foam material having a density of about 1.7 to 2.0 pcf and a thickness of ½ to ⅝ inch thick which has bonded to a top layer 14 and a bottom layer 18 composed of a substantially closed-cell cross-linked polyethylene foam material having a foam density of about 5 to 6 pcf, each layer having a thickness of ⅛ to 3/16 inch thick. The foam pad 12 includes "T"-shaped, spaced apart, generally uniform male and female sections 22 and 20, the male and female sections 22 and 20 being rounded at the edges and side angled at 35° to 45°. The foam pad 12 as illustrated and described permits for the easier insertion and interlockability of the side of the male and female sections 20 and 22 into the male and female sections of an adjoining pad 12 by the use of hand pressure, such as children's pressure against the top and bottom layers 14 and 18, due to the flexibility and ability to overcome the much lighter density type foam as the core layer 16.

Figure 2:
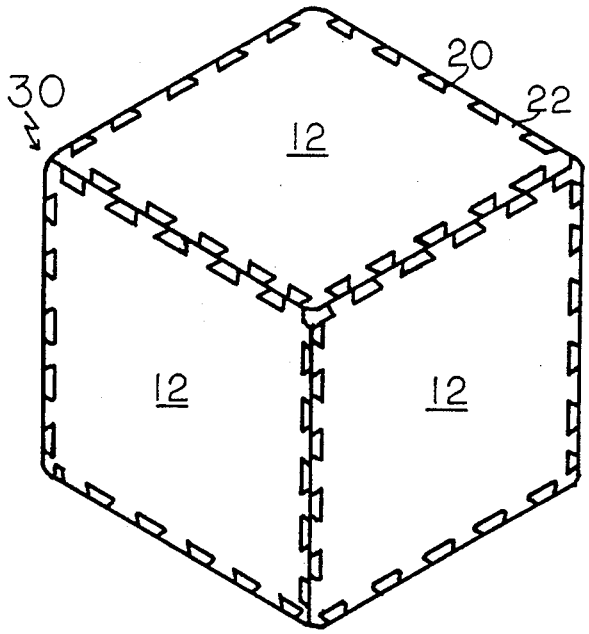
FIG. 2 is a perspective view from above of a three-dimensional box structure formed by a plurality of the interlockable foam pad of FIG. 1.

FIG. 2 is an illustration of a child's box-like structure formed by the plurality of the interlocked foam pads 12 of FIG. 1 showing the male and female sections 22 and 20 of the foam pads 12 interlocked together to form the three-dimensional box structure 30.

Figure 3:
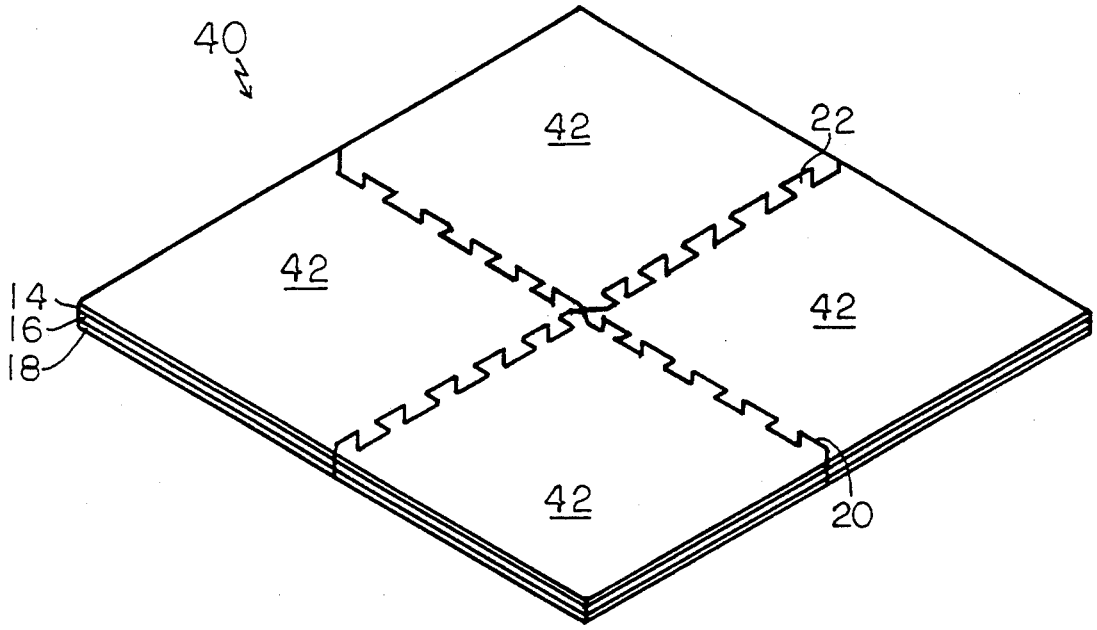
FIG. 3 is a perspective view from above of an exercise mat form employing the interlockable foam pad of the invention.

FIG. 3 is an illustration of a physical exercise mat employing an interlockable foam pad of the invention wherein the male and female sections 20 and 22 have only been placed along two or three adjoining edges, so that the other edge of the interlocked physical exercise mat 40 as illustrated is a straight edge.

The interlockable foam pad and interlockable foam pad structures thus provide for easy assembly and use of the pad and structures and overcome many disadvantages associated with prior art, single foam interlockable pads and structures.

What is claimed is:

1. An interlockable foam pad adapted for use for interlocking with another similar foam pad to form an interlocked foam pad structure comprising a plurality of interlocked foam pads, which foam pad comprises:

a) a core foam layer comprising a flexible foam material having a density of less than about 3 pcf;

b) a top and bottom foam layer bonded to the core foam layer, the top and bottom foam layers comprising a foam material having a foam density of greater than about 5 pcf and having a thickness ranging from about 10 to 25 percent of the thickness of the core foam layer; and c) the foam pad having at least along one side edge a plurality of alternating, spaced apart, uniform male and female sections, which male and female sections are adapted to interlock with slight hand pressure with male and female sections of an adjacent foam pad to permit a child to push against the top and bottom foam layers to depress the core foam layer so as to form in an easy, effective manner a desired interlocked foam pad structure.

2. The pad of claim 1 wherein the core and the top and bottom foam layers are comprised of a polyethylene foam material.

3. The pad of claim 1 wherein the male and female sections extend along all side edges of the foam pad.

4. The pad of claim 1 wherein the core, top and bottom foam layers comprise a cross-linked, substantially closed-cell polyethylene foam material.

5. The pad of claim 1 where the core foam layer has a thickness of about ½ to 1½ inches and the top and bottom foam layer has a thickness of about 1/16 to ¼ inches.

6. The pad of claim 1 wherein the male and female sections comprise "T"-shaped sections.

7. In combination, a plurality of foam pads of claim 1, each interlocked on one or more side edges to form an interlocked foam pad structure.

8. The combination of claim 7 which comprises a three-dimensional, box-like structure.

9. The combination of claim 7 which comprises a flat planar interlocked two-dimensional structure.

10. A method of assembling an interlocked foam pad structure which method comprises:

a) providing a plurality of foam pads of claim 1; and b) interlocking together the side edges of adjacent foam pads to form an interlocked structure by low pressure against the top or bottom foam layers to force the aligned male and female sections together by depressing the low density core foam layer without affecting the structural integrity of the interlocked foam pad structure.

11. An interlockable foam pad, adapted for use by interlocking with another foam pad to form an interlocked foam pad-containing structure, which foam pad comprises:

a) a core foam layer with a flexible, polyethylene foam material having a foam density of less than about 1 to 3 pcf and a thickness of about ¼–1½ inches;

b) top and bottom foam layers bonded to the core foam layer, the top and bottom foam layer comprising a flexible polyethylene foam sheet material having a foam density of about 5 to 12 pcf and a thickness of about 1/16 to ¼ inch; and c) the foam pad having at least along one side edge thereof a plurality of alternating spaced apart generally uniform male and female "T"-type sections, which sections are adapted to interlock with slight hand pressure with male and female side edge sections of an adjacent similar foam pad to permit a child to push easily against the top and bottom foam layers and to press the central foam layer to form a desired foam pad structure.

* * * * *